US007743936B2

(12) United States Patent
Suzuki

(10) Patent No.: US 7,743,936 B2
(45) Date of Patent: Jun. 29, 2010

(54) WATER HEATER

(75) Inventor: Takashi Suzuki, Nagoya (JP)

(73) Assignee: Rinnai Corporation, Aichi-ken (JP)

( * ) Notice: Subject to any disclaimer, the term of this patent is extended or adjusted under 35 U.S.C. 154(b) by 531 days.

(21) Appl. No.: 11/802,159

(22) Filed: May 21, 2007

(65) Prior Publication Data

US 2007/0267007 A1 Nov. 22, 2007

(30) Foreign Application Priority Data

May 22, 2006 (JP) ..... 2006-141054

(51) Int. Cl.
*F24H 1/00* (2006.01)
*B65D 53/00* (2006.01)

(52) U.S. Cl. ..... 220/378; 126/344; 220/4.01; 220/614; 220/694.1; 220/592.2

(58) Field of Classification Search ..... 220/378, 220/4.01, 614, 694.1, 731, 592.1, 592.06, 220/592.2; 126/344
See application file for complete search history.

(56) References Cited

U.S. PATENT DOCUMENTS 3,512,323 A * 5/1970 Hupfer ..... 52/309.9
3,752,350 A * 8/1973 Franck ..... 220/592.1
3,768,687 A * 10/1973 Spencer ..... 220/592.06
4,040,166 A * 8/1977 Morphy ..... 29/460
4,732,432 A * 3/1988 Keil et al. ..... 312/406.2
6,267,261 B1 * 7/2001 Lesage ..... 220/567.3
6,609,908 B2 * 8/2003 Guilmette et al. ..... 432/250
2007/0267007 A1 * 11/2007 Suzuki ..... 126/344

FOREIGN PATENT DOCUMENTS

JP S60-2250 1/1985
JP 60-213768 A 10/1985
JP 60-226661 11/1985
JP 06-281259 10/1994
JP 06-281259 A 10/1994
JP 2002-267153 9/2002
JP 2003-331345 A 11/2003

* cited by examiner

*Primary Examiner*—Anthony Stashick
*Assistant Examiner*—Niki M Eloshway
(74) *Attorney, Agent, or Firm*—Fitch, Even, Tabin & Flannery

(57) ABSTRACT

A water heater comprising: a case main body; a front cover for closing a front opening of the case main body; a waterproof packing member interposed between a first inner peripheral flange formed on an inner peripheral edge of the front opening of the case main body and a second inner peripheral flange formed on an inner peripheral edge of a rear end of the front cover; and a water receiver which is located below the waterproof packing member disposed in an upper region and which extends from the first inner peripheral flange of the case main body or the second inner peripheral flange of the front cover.

4 Claims, 6 Drawing Sheets

Fig. 5A
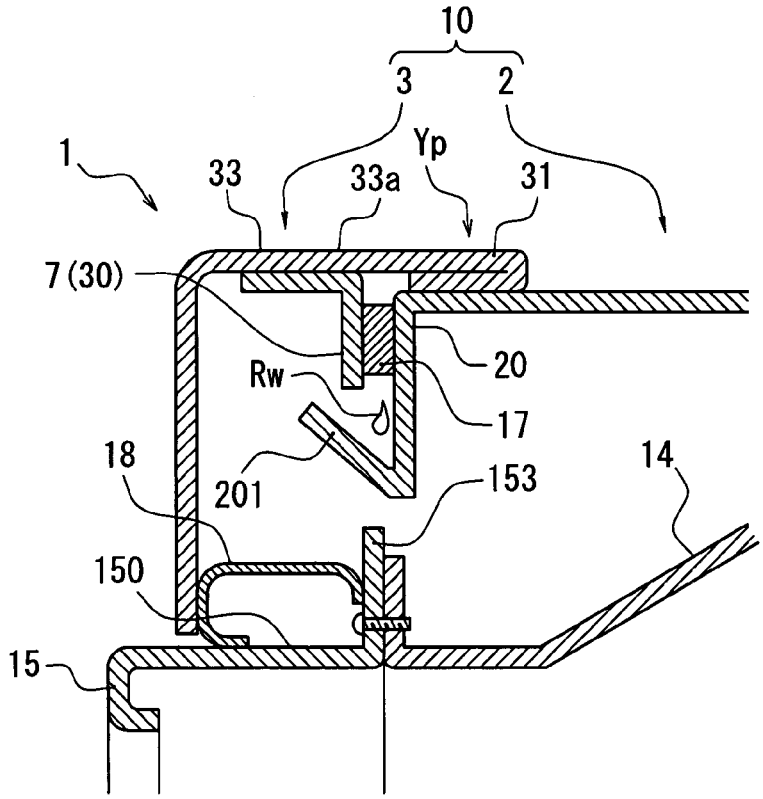
Fig. 5B
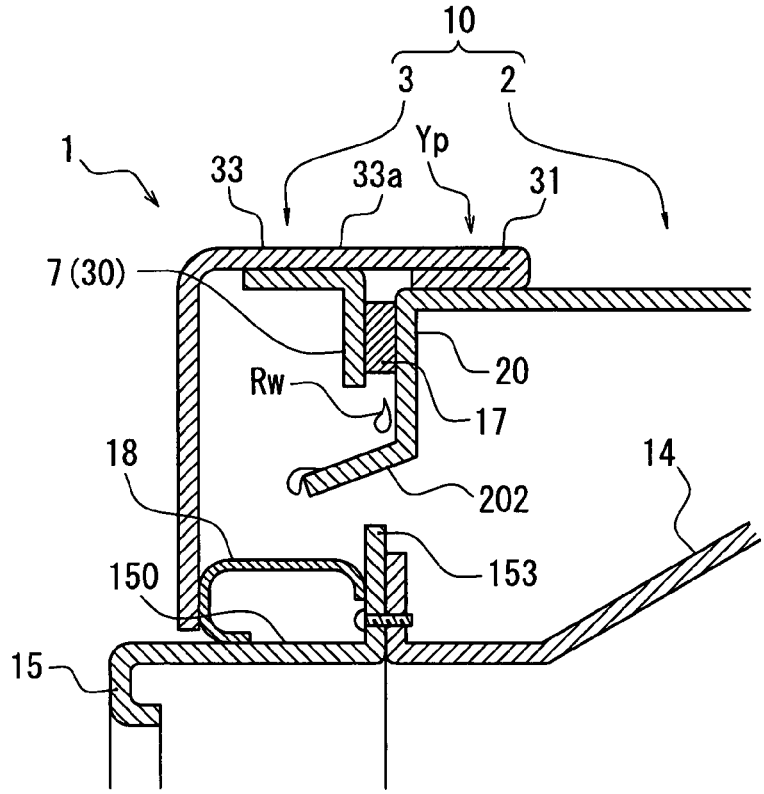
Fig. 5

WATER HEATER

RELATED CASE

This U.S. application claims foreign priority from Japanese Patent Application No. 2006-141054 filed May 22, 2006, the complete disclosure of which is incorporated herein by reference.

The present application is related to the U.S. patent Ser. No. 11/606,126 filed Nov. 30, 2006, which is commonly assigned to the same assignee and is hereby incorporated by reference in its entirely.

BACKGROUND OF THE INVENTION

1. Field of the Invention

The present invention relates to a water heater having inner peripheral flanges formed on a peripheral edge joint portion of a case main body and a front cover between which a waterproof packing member is interposed.

2. Description of the Related Art

To upgrade the design and to differentiate from other water heaters, there is an inner peripheral flange type water heater in which a first inner peripheral flange and a second inner peripheral flange are formed on a peripheral edge joint portion of a case main body and a front cover constituting an outer case, and the outer case does not have a projection. This kind of water heater is disposed outdoor in many cases. To prevent rainwater from entering into the outer case, a waterproof packing member is interposed between the first inner peripheral flange of the case main body and the second inner peripheral flange of the front cover. However, tightening of the front cover connected to the case main body is loosened, and the sealing performance of the waterproof packing member becomes insufficient in some cases. Also, in the case of an inner peripheral flange type water heater, since an outer periphery of the waterproof packing member is exposed outside, the waterproof packing member is exposed to sunshine, wind and rain, and whereby the sealing performance is likely to be deteriorated. Thus, in the inner peripheral flange type water heater, if the sealing performance of the waterproof packing member is deteriorated, rainwater is likely to enter the outer case from an upper region on the side of a top plate. As a result, if rainwater is dispersed to an inside combustion device or an inside electrical component, there is a possibility that the water heater does not operate normally.

SUMMARY OF THE INVENTION

The present invention has been accomplished in view of the above circumstances, and it is an object of the invention to provide a water heater capable of easily, reliably and inexpensively obtaining a structure for receiving rainwater coming from an upper region.

According to an aspect of the present invention, there is provided a water heater comprising:

a case main body;

a front cover for closing a front opening of the case main body;

a waterproof packing member interposed between a first inner peripheral flange formed on an inner peripheral edge of the front opening of the case main body and a second inner peripheral flange formed on an inner peripheral edge of a rear end of the front cover; and a water receiver which is located below the waterproof packing member disposed in an upper region and which extends from the first inner peripheral flange of the case main body or the second inner peripheral flange of the front cover.

Other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIG. 5 are cross-sectional views showing a portion of a water heater according to a second embodiment of the invention, wherein FIG. 5A shows a water heater having a V-shaped water receiver, and FIG. 5B shows a water heater having an dogleg-shaped water receiver.

DETAILED DESCRIPTION OF THE PREFERRED EMBODIMENTS

Figure 6:
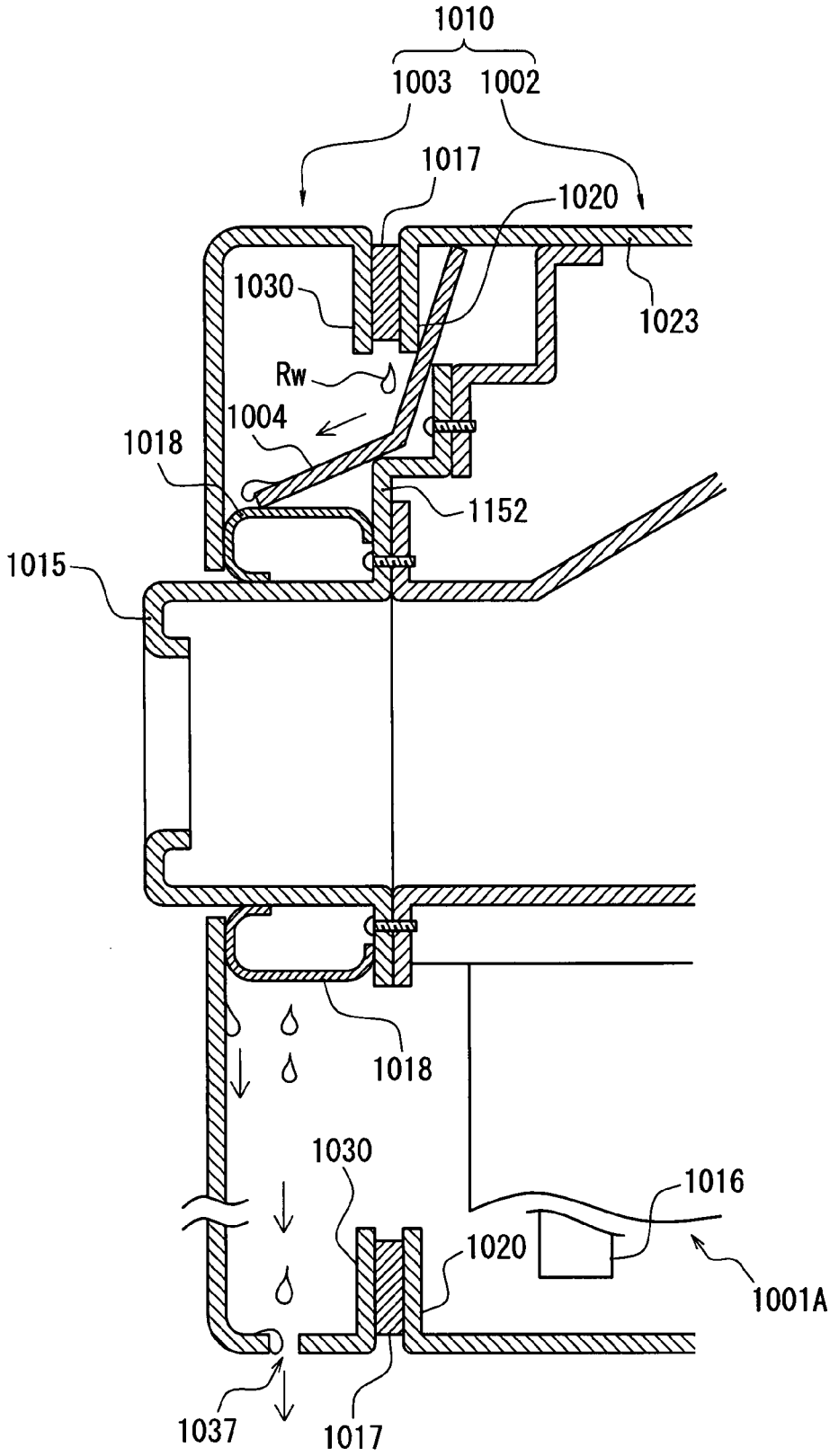
FIG. 6 is a cross-sectional view showing a structure of a water heater having a water receiving structure according to a reference example.

A water heater of a reference example shown in FIG. 6 for solving the problem caused when rainwater enters into the case main body can be found in U.S. Ser. No. 11/606,126, filed Nov. 30, 2006 (corresponding to Japanese Patent Application No. 2005-346379), and assigned to the same assignee as the present application. As shown in FIG. 6, according to this water heater, an outer case 1010 comprises a case main body 1002 and a front cover 1003, and a first inner peripheral flange 1020 and a second inner peripheral flange 1030 are respectively formed on a peripheral edge joint portion between the case main body 1002 and the front cover 1003. To prevent rainwater from entering into the outer case 1010, a waterproof packing member 1017 is interposed between the first inner peripheral flange 1020 of the case main body 1002 and the second inner peripheral flange 1030 of the front cover 1003. However, as described above, tightening of the front cover 1003 connected to the case main body 1002 is loosened, and the sealing performance of the waterproof packing member 1017 becomes insufficient in some cases. Also, in the case of an inner peripheral flange type water heater, since an outer periphery of the waterproof packing member 1017 is exposed outside, the waterproof packing member 1017 is exposed to sunshine, wind and rain, and whereby the sealing performance is likely to be deteriorated. Thus, in the inner peripheral flange type water heater, if the sealing performance of the waterproof packing member 1017 is deteriorated, rainwater is likely to enter the outer case 1010 from a joint clearance of the waterproof packing member 1017 disposed in the upper region. As a result, if rainwater is dispersed to an inside combustion device 1001A or an inside electrical component 1016, there is a possibility that the water heater does not operate normally. Therefore, in the water heater of the reference example, a detachable eaves-shaped member 1004 is mounted on an upper portion of a front opening of the case main body 1002. The eaves-shaped member 1004 is bent into an dogleg-shape, and is disposed such as to incline forward and to extend below the waterproof packing member 1017 disposed along a front opening upper edge of the case main body 1002. In this manner, even when rainwater Rw enters from the joint clearance of the waterproof packing member 1017 disposed in the upper region, the rainwater Rw drops into the upper portion of the eaves-shaped member 1004 and is received therein, and is discharged out from a discharge hole 1037 formed in a lower side of the front cover 1003.

In the water heater described above, however, since the eaves-shaped member 1004 is a separate member which is independent from the case main body 1002 and the front cover 1003, an operator forgets to attach the eaves-shaped member 1004 to the case main body 1002 in some cases. Further, the eaves-shaped member 1004 is placed on an annular packing material 1118 which surrounds the exhaust pipe 1015 in a state where the eaves-shaped member 1004 is inserted between the first inner peripheral flange 1020 of the case main body 1002 and an outer peripheral flange 1152 of a base end of the exhaust pipe 1015. Therefore, the eaves-shaped member 1004 is not always stably attached, and the eaves-shaped member 1004 may cause displacement in some cases. In such a case, rainwater Rw which enters from the joint clearance of the waterproof packing member 1017 disposed in the upper region is not received by the eaves-shaped member 1004 and is dispersed to the combustion device 1001A, the electrical component 1016 and the like, and the operation of the water heater may be deteriorated in some cases. Also, it is troublesome to assemble the eaves-shaped member 1004 into the case main body 1002. Further, since the eaves-shaped member 1004 is an independent member, cost thereof is increased. Hence, the present invention further improves a structure of the water heater and provides a water heater capable of easily, reliably and inexpensively obtaining the structure for receiving rainwater coming from an upper region.

Embodiments of the present invention will be explained with reference to the accompanying drawings below.

First Embodiment

Figure 1:
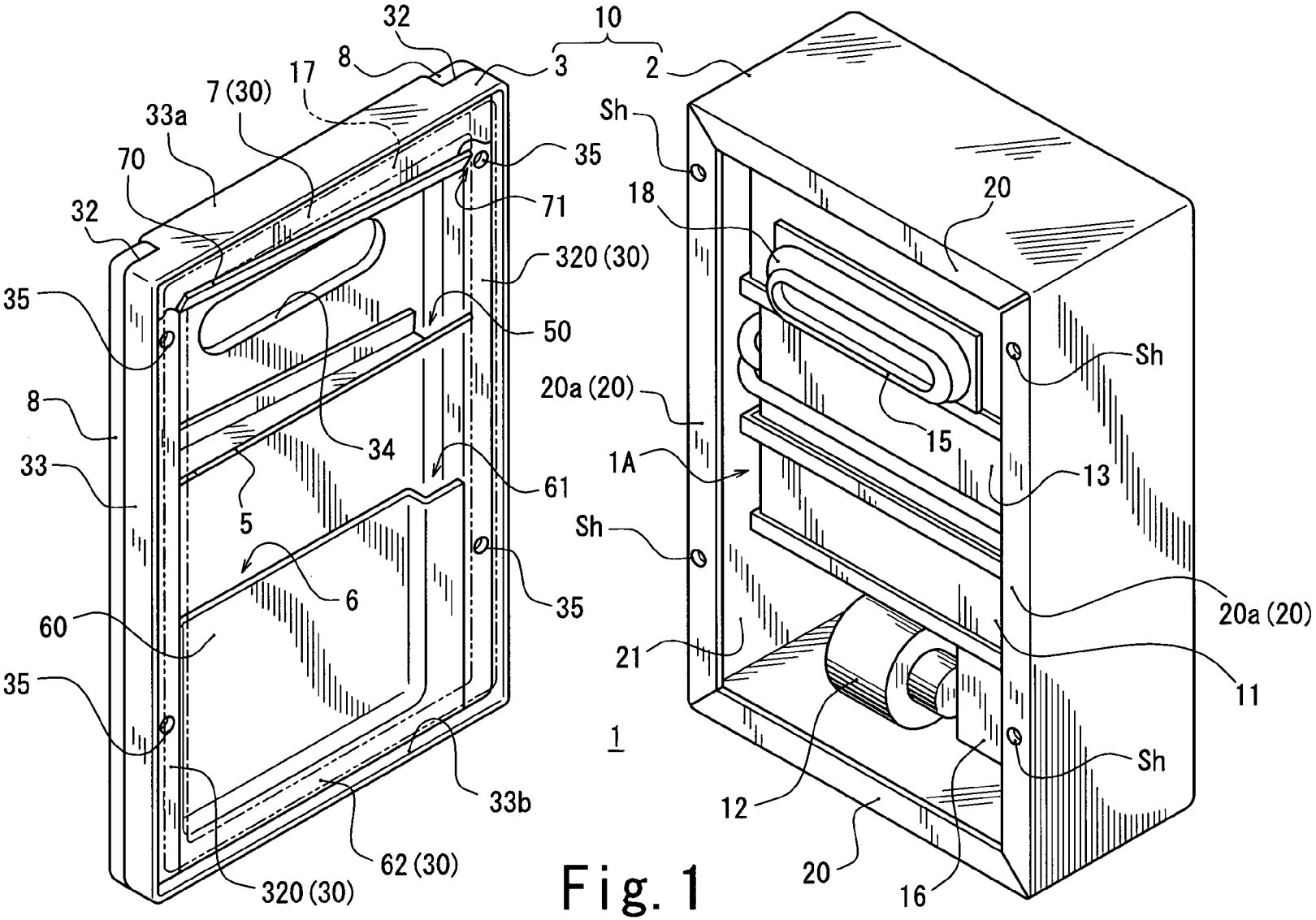
FIG. 1 is a perspective view of a water heater according to a first embodiment of the present invention in a state where a front cover is opened.
Figure 2:
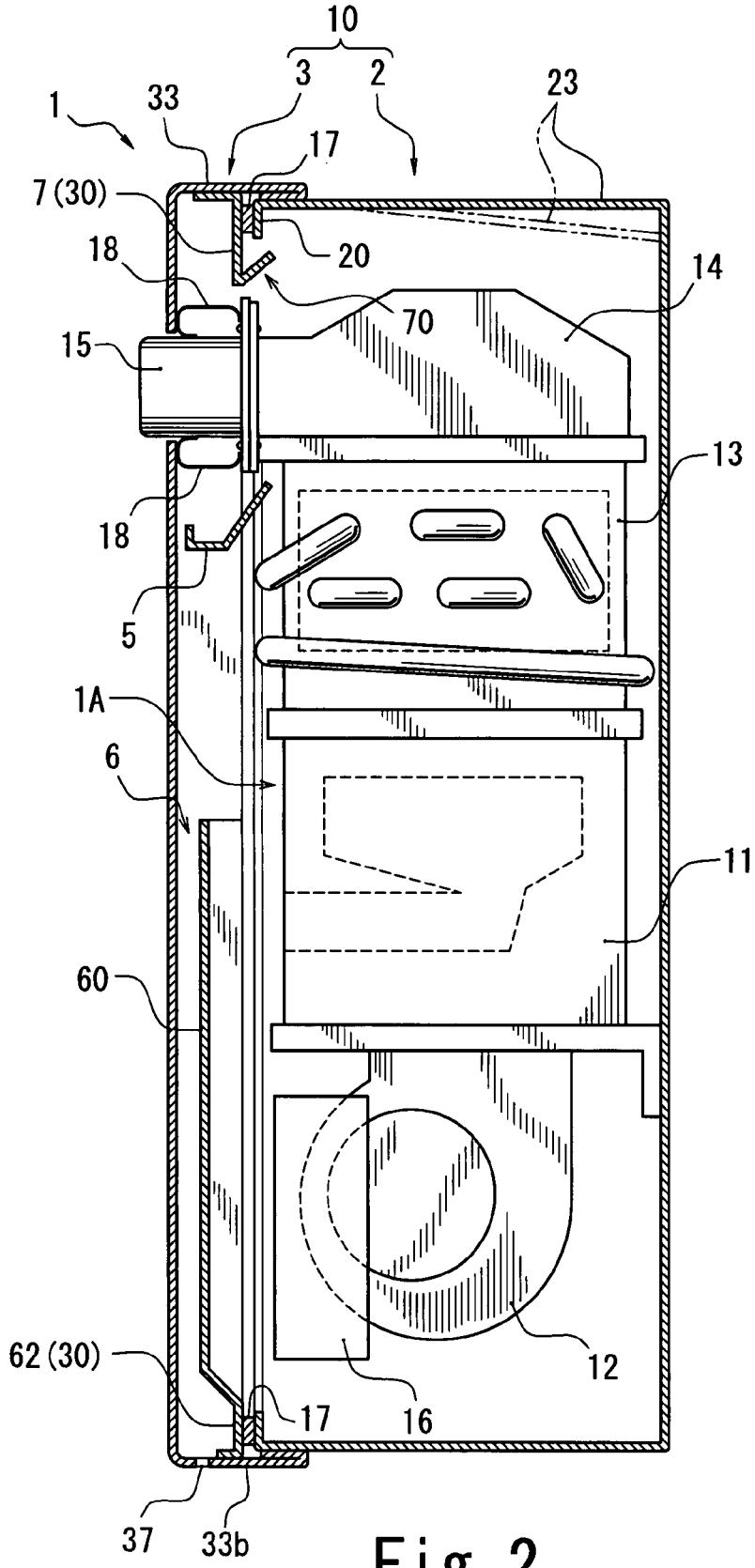
FIG. 2 is a cross-sectional view showing a structure of the water heater according to the first embodiment of the invention.
Figure 3:
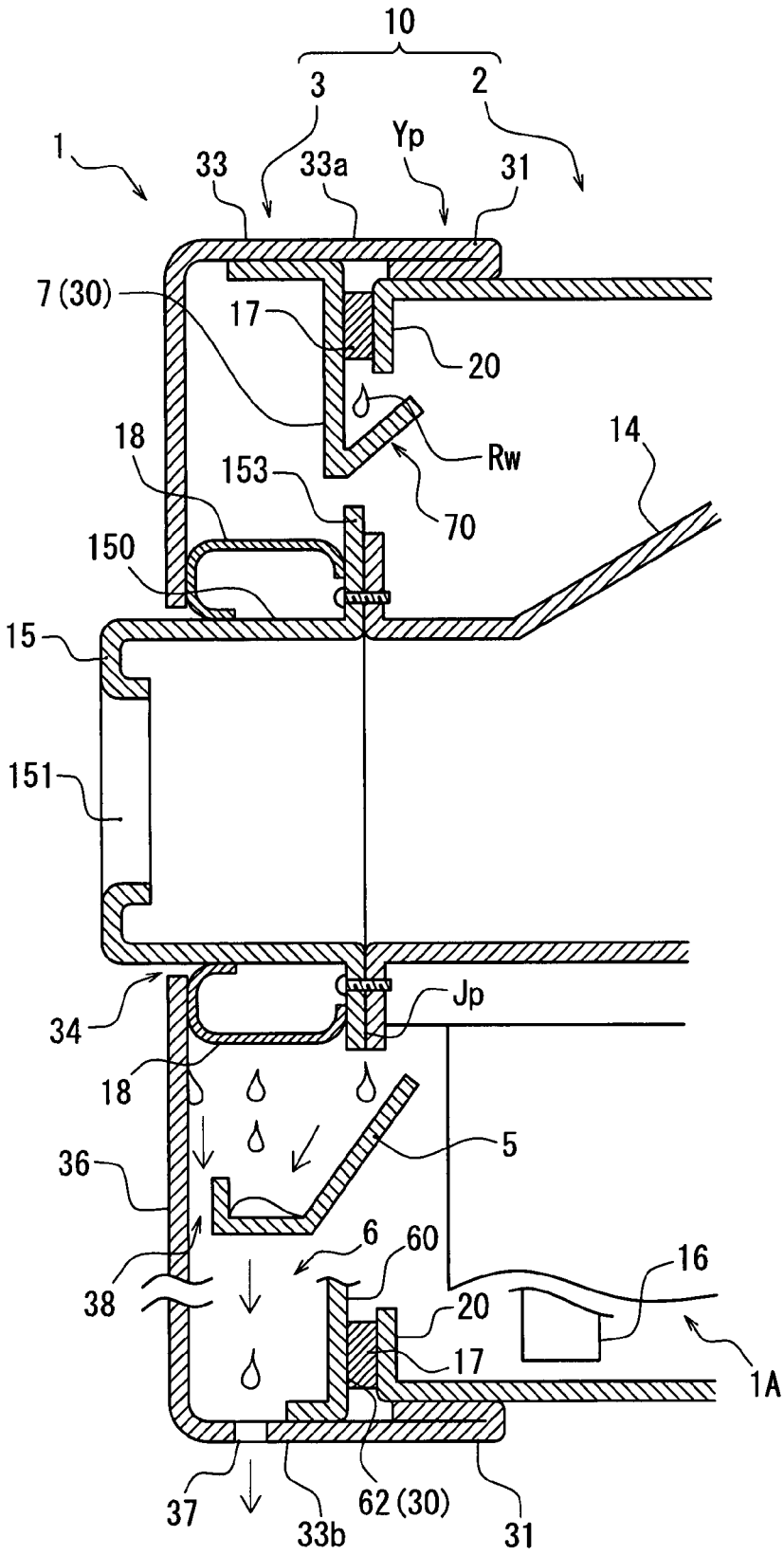
FIG. 3 is a cross-sectional view showing a main portion of the water heater according to the first embodiment of the invention.

As shown in FIGS. 1 to 3, according to a water heater 1 of the first embodiment, a combustion device 1A and an electrical component 16 are accommodated in a rectangular box-like outer case 10. The outer case 10 comprises a case main body 2 in which the combustion device 1A and the electrical component 16 are disposed, and a front cover 3 for covering a front opening 21 of the case main body 2. The combustion device 1A comprises an air-supply fan 12, a combustion unit 11 provided therein with a gas burner, a heat exchange unit 13, an exhaust collector 14 and an exhaust pipe 15.

The case main body 2 is formed by forming a plate metal into a rectangular box-like shape whose front surface is opened. A first inner peripheral flange 20 having an inwardly bent end is formed on an inner peripheral edge of the front opening 21 of the case main body 2. Screw holes Sh are formed in upper and lower portion of both left and right vertical sides 20*a* of the first inner peripheral flange 20. The front cover 3 is fixed to the vertical sides 20*a* through the screw holes Sh.

The front cover 3 is obtained by forming a plate metal into a shallow pan-like shape whose rear side is opened. The front cover 3 is formed with a rear end 31 in which an open end of an outer peripheral plate 33 is folded inward (see FIG. 3). The rear end 31 of the front cover 3 is fitted over a front end outer periphery of the case main body 2 substantially tightly, and the front cover 3 covers the front opening 21 of the case main body 2.

Steps 32 into which cosmetic covers 8 are fitted are formed on both left and right sides of a front surface of the front cover 3. Rearwardly swelling vertical side bulge portions 320 are formed on back sides of the steps 32. In a lower surface of the upper side 33*a* of the outer peripheral plate 33 of the front cover 3, a seal plate 7 extending laterally of the front cover 3 is suspended from an upper edge of the second inner peripheral flange 30 by spot welding or the like. A pocket plate 60 stands from an upper surface of a lower side 33*b* of the outer peripheral plate 33 of the front cover 3. Further, a rearwardly swelling lower side bulge portion 62 is formed on a lower portion of the pocket plate 60.

Therefore, when the front cover 3 is observed from the back side, a suspending portion of the seal plate 7 provided on the upper portion of rear side of the front cover 3, the lower side bulge portion 62 of the pocket plate 60 provided on the lower portion of rear side of the front cover 3, and the vertical side bulge portions 320 on the back side of the left and right steps 32 form a flush rectangular frame as a whole, and with these members, a second inner peripheral flange 30 is formed in the inner peripheral edge of the rear end of the front cover 3. A rectangular frame-like waterproof packing member 17 is interposed between the second inner peripheral flange 30 of the front cover 3 and the first inner peripheral flange 20 of the case main body 2 (see FIGS. 2 and 3). By disposing the waterproof packing member 17, waterproof against rainwater is secured in the peripheral edge joint portion between the front cover 3 and the case main body 2.

An overlapped portion Yp formed by extending the rear end 31 of the outer peripheral plate 33 of the front cover 3 to an outer surface of the case main body 2 is provided at a joint portion between the front cover 3 and the case main body 2 (see FIG. 3). In this manner, the waterproof packing member 17, the first inner peripheral flange 20 of the case main body 2, and the second inner peripheral flange 30 of the front cover 3 are screened by the overlapped portion Yp. Therefore, rainwater is prevented from entering the joint portion between the front cover 3 and the case main body 2. Further, influence of sunshine, wind and rain on the waterproof packing member 17 is suppressed, deterioration of the waterproof packing member 17 with time is suppressed and therefore, long term stability of waterproof is also secured. Further, the outward appearance is not deteriorated, and design of the water heater is further upgraded.

An annular packing material 18 is sandwiched between the front cover 3 and an outer peripheral flange 153 of the exhaust pipe 15. The annular packing material 18 is fitted over a body 150 of the exhaust pipe 15 (see FIG. 3). With this, rainwater is prevented from entering from the exhaust pipe insertion port 34 formed in the front cover 3.

In this manner, rainwater is prevented from entering into the outer case 10. In this embodiment, the following structure is further provided for receiving rainwater entering into the water heater 1 so that the operation of the water heater 1 is not deteriorated even when the sealing performance of the waterproof packing member 17 or the annular packing material 18 is lowered.

First, a lower water receiver 6 is provided between a rear surface of the front cover 3 and a pocket plate 60 provided on a lower portion of the front cover 3. An enlarged opening 61 is formed in one side of the lower water receiver 6 (see FIG. 1). The enlarged opening 61 is located nearly vertical below the drainage end 71 and a drainage end 50 of a upper water receiver 5. The lower side 33*b* of the outer peripheral plate 33 of the front cover 3 is formed with a water-discharge hole 37 through which water in the lower water receiver 6 is discharged (see FIGS. 2 and 3). Accordingly, as the rainwater which enters into the outer case 10 is received by the lower water receiver 6 and the received rainwater flows a front cover side of the pocket plate 60, this structure can avoid a case in which rainwater is dispersed to the electrical component 16 and the combustion device 1A disposed within the case main body 2. Rainwater is discharged outside from the water-discharge hole 37 of the lower side 33*b*.

The gutter-shaped upper water receiver 5 whose upper portion is opened is provided above the lower water receiver 6. The upper water receiver 5 is disposed below a joint portion Jp between the exhaust pipe 15 and the exhaust collector 14. The upper water receiver 5 is inclined in the longitudinal direction thereof, and one end of the upper water receiver 5 has a drainage end 50 which is lower than the other end (see FIG. 1). Therefore, rainwater received by the upper water receiver 5 drops into the enlarged opening 61 provided in a side of the lower water receiver 6 from the drainage end 50 of the one end of the upper water receiver 5.

A gap 38 is formed between the upper water receiver 5 and the front surface plate 36 of the front cover 3. Rainwater which runs along the rear surface of the front surface plate 36 flows downward toward the lower water receiver 6 through the gap 38 (see FIG. 3).

As shown in FIG. 3, the seal plate 7 constitutes the upper edge of the second inner peripheral flange 30 of the front cover 3. A lower portion of the seal plate 7 is formed with a gutter-shaped water receiver 70 having an opened upper side. The water receiver 70 is formed such that the seal plate 7 extends below the waterproof packing member 17 disposed in the upper region of the peripheral edge joint portion of the first inner peripheral flange 20 of the case main body 2 and the second inner peripheral flange 30 of the front cover 3, and a tip end of the seal plate 7 is formed into a V-shape having an acute angle of 60° on the side of the case main body 2. The water receiver 70 is inclined in the longitudinal direction thereof, and one end of the water receiver 70 has a drainage end 71 which is lower than the other end (see FIG. 1). Therefore, rainwater Rw which enters from the joint clearance of the waterproof packing member 17 disposed in the upper region of a peripheral edge joint portion of the case main body 2 and the front cover 3 due to deterioration of the sealing performance is received by the water receiver 70 (rainwater receiving structure) and then, the rainwater Rw flows downward along the longitudinal direction of the water receiver 70, and drops into the enlarged opening 61 formed in one side of the lower water receiver 6 from the drainage end 71.

Next, the assembling operation between the front cover 3 and the case main body 2 will be explained.

Figure 4:
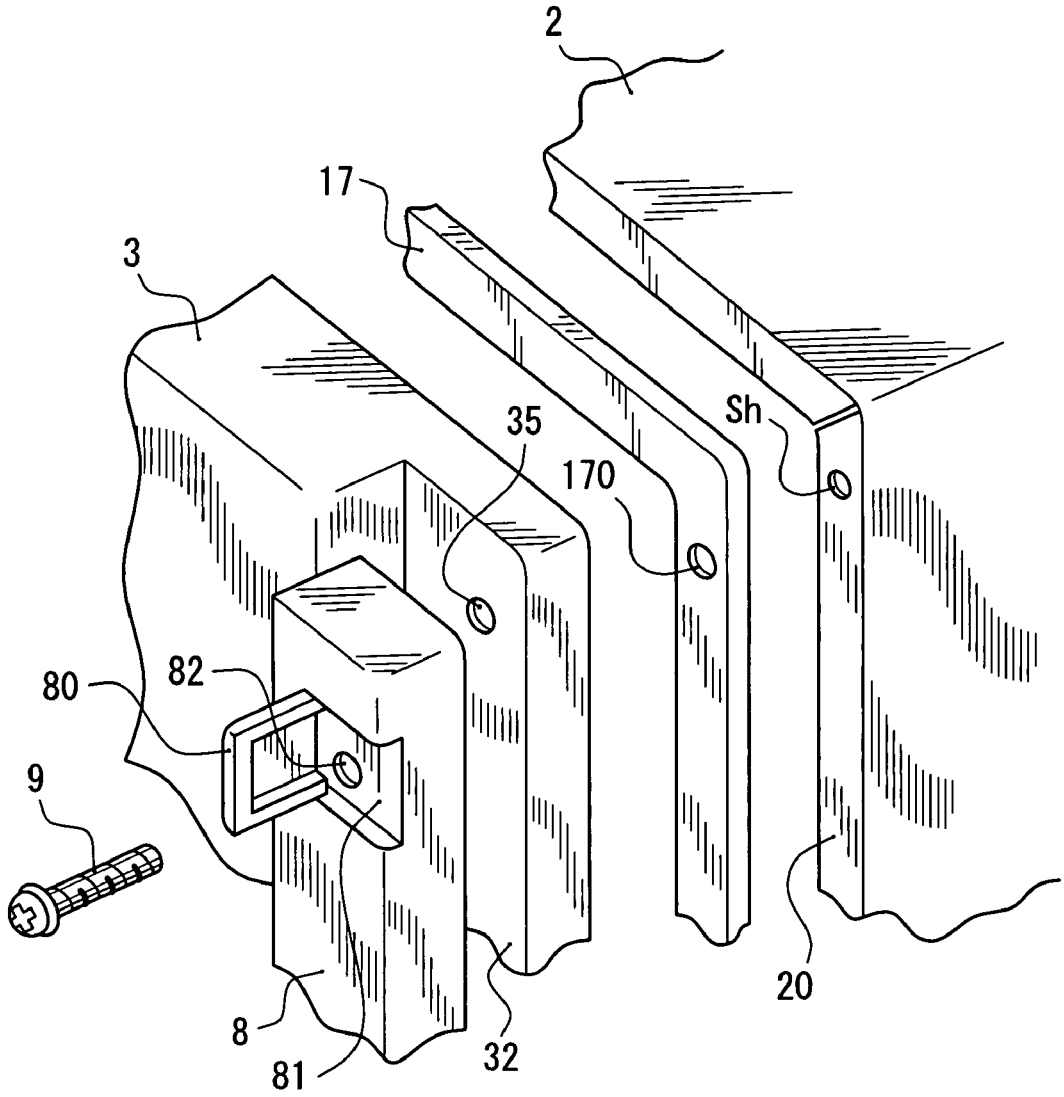
FIG. 4 is a perspective view of a mounting portion of a cosmetic cover according to the first embodiment of the invention.

As shown in FIG. 4, the through holes 35 opposed to the screw holes Sh of the inner peripheral flange 20 of the case main body 2 are formed in upper and lower portions of the left and right steps 32 of the front cover 3. Through holes 170 opposed to the screw holes Sh of the case main body 2 are also formed in upper and lower portions of the waterproof packing member 17. Through holes 82 are formed in upper and lower bottoms of recesses 81 of the cosmetic cover 8 disposed on each of the steps 32 of the front cover 3. The recess 81 is opened and closed by an open/close lid 80. The fixing screw 9 is inserted into the through hole 82 of the cosmetic cover 8, the through hole 35 of the front cover 3 and the through hole 170 of the waterproof packing member 17, and screwed into the screw hole Sh of the main body 2. With this, the waterproof packing member 17 is sandwiched between the second inner peripheral flange 30 of the front cover 3 and the first inner peripheral flange 20 of the case main body 2, and the front cover 3 and the case main body 2 are connected each other. At the same time, the cosmetic cover 8 is mounted on the front cover 3. When the open/close lid 80 of the cosmetic cover 8 is closed, the fixing screw 9 is concealed.

According to the water heater 1 of the first embodiment, the seal plate 7 constituting the upper edge of the second inner peripheral flange 30 of the front cover 3 is integrally formed with the water receiver 70. The seal plate 7 is used for allowing the waterproof packing member 17 to be interposed. Since the water receiver 70 is provided using the seal plate 7, by assembling the front cover 3 and the case main body 2, it is possible to form a rainwater receiving structure for receiving rainwater Rw which enters from the joint clearance of the waterproof packing member 17 disposed in the upper region (see FIG. 3). Thus, as an independent member such as the eaves-shaped member 1004 (FIG. 6) is not required for providing the rainwater receiving structure, neither does a case where an operator forgets to attach the rainwater receiving structure occur, nor does a positional displacement occur. Further, the rainwater receiving structure can easily be assembled. Furthermore, since additional member such as the eaves-shaped member 1004 is not required, cost is reduced.

As described above, the water heater 1 of the first embodiment includes the water receiver 70 which is located below the waterproof packing member 17 disposed in the upper region and which extends from the seal plate 7 constituting the upper edge of the second inner peripheral flange 30 of the front cover 3. Therefore, by assembling the front cover 3 and the case main body 2, it is possible to easily, reliably and inexpensively obtain the receiving structure of rainwater Rw entering from the joint clearance of the waterproof packing member 17 disposed in the upper region, without adding another member.

The tip end of the seal plate 7 is bent to provide the water receiver 70, and the strength of the seal plate 7 (i.e., portion constituting the upper edge of the second inner peripheral flange 30 of the front cover 3) is enhanced by this bent tip end. Thus, the seal plate 7 substantially equally presses the entire upper region of the waterproof packing member 17 and the sealing performance around this area is enhanced. As a result, the sealing performance in the upper region where the rainwater is most likely to be dispersed is reliably obtained, and the waterproof against rainwater is further enhanced.

Second Embodiment

In the first embodiment, the water receiver 70 extends from the seal plate 7 of the front cover 3 and is integrally formed with the seal plate 7. In the second embodiment, as shown in FIG. 5, an upper edge of the first inner peripheral flange 20 of the case main body 2 is extended below the waterproof packing member 17 disposed in the upper region of a peripheral edge joint portion of a case main body 2 and a front cover 3, and a tip end of the upper edge of the first inner peripheral flange 20 is bent toward the front cover 3. In this manner, a water receiver 201 (or water receiver 202) is integrally formed together with the first inner peripheral flange 20 of the case main body 2.

In the second embodiment, like the water receiver of the first embodiment, the tip end of the water receiver 201 (or water receiver 202) may be bent at an acute angle to form into the V-gutter-shape whose upper side is opened (water receiver 201 shown in FIG. 5A), or the tip end thereof may be bent at an obtuse angle to form into an dogleg-eaves-shape whose upper side is opened (water receiver 202 shown in FIG. 5B).

It is preferable that the water receiver 201 whose tip end is bent into the V-shape shown in FIG. 5A is formed with a drainage end on one end such as to incline in the longitudinal direction, but in the case of the water receiver 202 whose tip end is bent into the dogleg shape as shown in FIG. 5B, the drainage end needs not be inclined in the longitudinal direction of the water receiver 202 and may be formed horizontally. That is, as a shape of the water receiver 201 (or the water receiver 202), it is possible to appropriately select such a shape that rainwater received by the water receiver does not drop toward the case main body 2. Other structures and effects are the same as those of the above first embodiment.

Other Embodiments i) Although the water receiver 70 (201, 202) is bent at one single location, but it may be bent at a plurality of locations. That is, it is possible to appropriately select such a shape that rainwater received by the water receiver does not drop toward the case main body 2.

ii) As the overlapped portion Yp which conceals the waterproof packing member 17, the first inner peripheral flange 20 and the second inner peripheral flange 30, a front end extending from a peripheral edge of the front opening 21 of the case main body 2 toward the front cover 3 may be formed. A rear end outer periphery of the front cover 3 may be fitted over the front end of the case main body 2 substantially tightly.

iii) The top plate 23 of the case main body 2 may be rearwardly and downwardly inclined as shown with two-dot chain lines in FIG. 2. In this manner, rain falling on the top plate 23 flows rearward, and rainwater is less likely to flow toward the upper region in which the waterproof packing member 17 is disposed.

iv) The water heater described above can be applied to various water heaters such as a hot water circulation type water heater in which hot water is circulated between the water heater and a heating radiator disposed indoors, a gas water heater, a cogeneration type water heater and an electric water heater.

As described in detail above, according to an aspect of the present invention, there is provided a water heater comprising:

a case main body;

a front cover for closing a front opening of the case main body;

a waterproof packing member interposed between a first inner peripheral flange formed on an inner peripheral edge of the front opening of the case main body and a second inner peripheral flange formed on an inner peripheral edge of a rear end of the front cover; and a water receiver which is located below the waterproof packing member disposed in an upper region and which extends from the first inner peripheral flange of the case main body or the second inner peripheral flange of the front cover.

According to the above feature, even when rainwater enters from the joint clearance of the waterproof packing member disposed in the upper region of a peripheral edge joint portion of a case main body and a front cover, the rainwater can be received by the water receiver, and the operation of the water heater is not deteriorated.

Namely, since the water heater includes the water receiver which is located below the waterproof packing member disposed in the upper region and which extends from the first inner peripheral flange of the case main body or the second inner peripheral flange of the front cover, the rainwater receiving structure is formed by assembling the front cover and the case main body. Thus, it is possible to easily, reliably and inexpensively obtain the receiving structure of rainwater entering from the upper region without adding another member. Further, since an independent member such as the eaves-shaped member is not required for providing the rainwater receiving structure, neither does a case where an operator forgets to attach the rainwater receiving structure occur, nor does a positional displacement occur.

The water receiver may be formed by extending a seal plate constituting an upper edge of the second inner peripheral flange of the front cover below the waterproof packing member disposed in the upper region, and by bending a tip end of the seal plate toward the case main body.

According to the above feature, the seal plate constitutes the upper edge of the second inner peripheral flange of the front cover, and the seal plate is a constituent portion used for allowing the waterproof packing member to be interposed. Therefore, by forming the water receiver using the seal plate, another member such as the eaves-shaped member is not required for forming the rainwater receiving structure. As a result, neither does a case where an operator forgets to attach the rainwater receiving structure occur, nor does a positional displacement occur. Further, the rainwater receiving structure can easily be assembled, and cost is reduced. Furthermore, the tip end of the seal plate is bent to provide the water receiver, and the strength of the seal plate (i.e., portion constituting the upper edge of the second inner peripheral flange of the front cover) is enhanced by this bent tip end. Thus, the seal plate substantially equally presses the entire upper region of the waterproof packing member and the sealing performance around this area is enhanced. As a result, the sealing performance in the upper region where the rainwater is most likely to be dispersed is reliably obtained, and the waterproof against rainwater is further enhanced.

The water receiver may be formed by extending an upper edge of the first inner peripheral flange of the case main body below the waterproof packing member disposed in the upper region, and by bending a tip end of the upper edge of the first inner peripheral flange toward the front cover.

According to the above feature, since the upper edge of the first inner peripheral flange of the case main body is a constituent portion used for allowing the waterproof packing member to be interposed, by forming the water receiver using the upper edge, another member such as the eaves-shaped member is not required for forming the rainwater receiving structure. As a result, neither does a case where an operator forgets to attach the rainwater receiving structure occur, nor does a positional displacement occur. Further, the rainwater receiving structure can easily be assembled, and cost is reduced. Furthermore, since the water receiver is formed by bending the tip end of the upper edge, the strength of the upper edge of the first inner peripheral flange of the case main body is enhanced by this bent tip end. Thus, the upper edge substantially equally presses the entire upper region of the waterproof packing member and the sealing performance around this area is enhanced. As a result, the sealing performance in the upper region where the rainwater is most likely to be dispersed is reliably obtained, and the waterproof against rainwater is further enhanced.

The water receiver may have a gutter shape having an opened upper side, and the water receiver may be inclined in a longitudinal direction of the water receiver.

According to the above feature, rainwater accumulated in the water receiver can flow downward from a space between the end of the water receiver of either one of the left and right sides in the longitudinal direction and the case main body or the front cover so that the operation of the water heater is not deteriorated.

The above water heater may further include a lower water receiver formed between a rear surface of the front cover and a pocket plate provided on a lower portion of the front cover.

According to the above feature, when the water receiver which has a dogleg shape is provided, the rainwater which is received by the water receiver drops into the lower water receiver. Accordingly, this structure can avoid a case in which rainwater is dispersed to the electrical component and the combustion device disposed within the case main body.

In the above water heater, the water receiver may have a drainage end, the lower water receiver may have an enlarged opening in one side thereof, and the enlarged opening may be located nearly vertical below the drainage end.

According to the above feature, when the water receiver which has a gutter shape and which is inclined in the longitudinal direction is provided, the rainwater which is received by the water receiver flows downward along the longitudinal direction of the water receiver, and drops into the enlarged opening formed in one side of the lower water receiver. Accordingly, this structure can avoid a case in which rainwater is dispersed to the electrical component and the combustion device disposed within the case main body.

As described above, the water heater includes the water receiver which is located below the waterproof packing member disposed in an upper region and which extends from the first inner peripheral flange of the case main body or the second inner peripheral flange of the front cover. Thus, it is possible to easily, reliably and inexpensively obtain the receiving structure of rainwater entering from the upper region by assembling the front cover and the case main body, without adding another member.

The present application claims priority based on a Japanese Patent Application No. 2006-141054 filed on May 22, 2006, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A water heater comprising:

a case main body;

a front cover for closing a front opening of the case main body;

a waterproof packing member interposed between a first inner peripheral flange formed on an inner peripheral edge of the front opening of the case main body and a second inner peripheral flange formed on an inner peripheral edge of a rear end of the front cover; and a water receiver which is located below the waterproof packing member disposed in an upper region and which extends from the first inner peripheral flange of the case main body or the second inner peripheral flange of the front cover, a lower water receiver formed between a rear surface of the front cover and a pocket plate provided on a lower portion of the front cover, wherein the water receiver has a drainage end, and the lower water receiver has an enlarged opening in one side thereof, and the enlarged opening is located nearly vertical below the drainage end.

2. The water heater according to claim 1, wherein the water receiver is formed by extending a seal plate constituting an upper edge of the second inner peripheral flange of the front cover below the waterproof packing member disposed in the upper region, and by bending a tip end of the seal plate toward the case main body.

3. The water heater according to claim 1, wherein the water receiver is formed by extending an upper edge of the first inner peripheral flange of the case main body below the waterproof packing member disposed in the upper region, and by bending a tip end of the upper edge of the first inner peripheral flange toward the front cover.

4. The water heater according to claim 1, wherein the water receiver has a gutter shape having an opened upper side, and the water receiver is inclined in a longitudinal direction thereof.

* * * * *